US008189318B2

(12) United States Patent
Norton

(10) Patent No.: US 8,189,318 B2
(45) Date of Patent: May 29, 2012

(54) ELECTROSTATIC DISCHARGING OVERSHOE

(75) Inventor: Douglas E. Norton, Scarborough, ME (US)

(73) Assignee: 32north Corporation, Biddeford, ME (US)

( * ) Notice: Subject to any disclaimer, the term of this patent is extended or adjusted under 35 U.S.C. 154(b) by 103 days.

(21) Appl. No.: 12/269,142

(22) Filed: Nov. 12, 2008

(65) Prior Publication Data

US 2009/0147430 A1 Jun. 11, 2009

Related U.S. Application Data

(60) Provisional application No. 60/987,238, filed on Nov. 12, 2007.

(51) Int. Cl.
*H05F 3/00* (2006.01)

(52) U.S. Cl. ..... 361/223; 361/224

(58) Field of Classification Search ..... 361/234, 361/223–224

See application file for complete search history.

(56) References Cited

U.S. PATENT DOCUMENTS

| | | | | |
|---|---|---|---|---|
| 3,801,868 | A * | 4/1974 | Bryant | 36/9 R |
| 6,003,247 | A * | 12/1999 | Steffe | 36/45 |
| 6,982,861 | B2 * | 1/2006 | Lee et al. | 361/223 |
| 2003/0231454 | A1 * | 12/2003 | Hee | 361/223 |

* cited by examiner

*Primary Examiner* — Dharti Patel
(74) *Attorney, Agent, or Firm* — Strategic Patents, P.C.

(57) ABSTRACT

An electrostatic discharging, detachable, overshoe, includes an electrically conductive flexible skeleton with oversized heel and toe regions for placing over footwear, and a conductive element situated to facilitate conducting static electricity between a body of a wearer of the footwear and the overshoe. The overshoe can be worn over a wide variety of street, work, office, and specialty footwear and may support reduction of electro-static discharge buildup on the body of the wearer by safely conducting any electrical charge generated or transferred to the body of the wearer to a grounded surface such as an electrically conductive floor.

23 Claims, 19 Drawing Sheets

ELECTROSTATIC DISCHARGING OVERSHOE

CROSS-REFERENCE TO RELATED APPLICATIONS

This application claims the benefit of the following provisional application, which is hereby incorporated by reference in its entirety:

U.S. Provisional Application No. 60/987,238, entitled "Electrostatic Discharging Overshoe" filed on Nov. 12, 2007.

BACKGROUND

1. Field

The present invention relates to the field of electrostatic discharging overshoes.

2. Description of the Related Art

In recent years the speed and sensitivity of manufacturing processes has increased and the locations of manufacture may be decentralized and characterized by varying levels of outside infrastructure. Moreover, even with adequate infrastructure, traditional methods of electrostatic charge dissipation may be expensive and unreliable. Rapid manufacturing may generate electrostatic charges which for safety and other reasons require discharging. In addition, accumulated electrostatic charges may be detrimental to sensitive processes. Given the above, traditional methods of electrostatic discharging may be largely inadequate. The present invention relates to an electrostatic discharging overshoe that will facilitate the discharge of electrostatic charges under a variety of circumstances.

SUMMARY

An electrostatic discharging, detachable, overshoe, may include an electrically conductive flexible skeleton with oversized heel and toe regions for placing over footwear, and a conductive element situated to facilitate conducting static electricity between a body of a wearer of the footwear and the overshoe. The overshoe may be worn over a wide variety of street, work, office, and specialty footwear and may support reduction of electro-static discharge (ESD) buildup on the body of the wearer by safely conducting any electrical charge generated or transferred to the body of the wearer to a grounded surface such as an electrically conductive floor.

The overshoe may be flexible, may provide cushioning for the wearer, and may increase friction between the wearer's footwear and a floor or other surface for walking or standing. Because the overshoe is designed to be worn over the wearer's footwear, the wearer does not require owning and wearing dedicated footwear for the various functions of the overshoe, such as ESD protection, comfort, slip-resistance, and personal safety. The overshoe may be available in a variety of configurations including open toe, closed toe, open heel, closed heel, slip over, closed covering, full bootie, low cut, below the ankle, and the like.

The flexibility of the overshoe may be facilitated by selecting material that is soft, stretchy, flexible, and robust enough to withstand repeated use and long life wear. There is a variety of conductive elastomer, plastic, vinyl, and other composite materials that may be appropriate for the overshoe. By making the overshoe flexible and stretchy, the overshoe may be slipped onto a wearer's footwear and may be kept in place by a tight fit between the overshoe and the outer surfaces of the footwear. The overshoe may have a slip-resistant coefficient of friction may allow the overshoe to grip the footwear surfaces (e.g. the sole, front and top of the toe, back of the heel) further providing a tight fit that may be appropriate for many uses and use environments.

The electrostatic dissipating overshoe may be available in various sizes. Because the overshoe is stretched to be slipped over footwear, a single overshoe size may be used with a range of footwear sizes and shapes. The various sizes of the overshoe may in total cover a wide range of footwear sizes, such as from a US women's size 5 to a US men's size 13.

An electrostatic discharging, detachable, overshoe may comprise an electrically conductive flexible skeleton for placing over footwear, wherein the skeleton has oversized heel and toe regions on a bottom surface of the skeleton; and a conductive element situated to complete an electrical circuit between a body of a wearer of the footwear and the overshoe. In embodiments, the skeleton of the electrostatic discharging, detachable, overshoe may cover substantially all of the footwear outer surface. In embodiments, the skeleton of the electrostatic discharging, detachable, overshoe may cover substantially all of the footwear front, back, and sides, while leaving substantially all of the footwear top exposed. In embodiments, the skeleton of the electrostatic discharging, detachable, overshoe may cover portions of the footwear front, back, and sides. In embodiments, the skeleton of the electrostatic discharging, detachable, overshoe may comprise a series of bonded, narrow elongated segments. In embodiments, the skeleton of the electrostatic discharging, detachable, overshoe may be molded in a single piece. In embodiments, the skeleton of the electrostatic discharging, detachable, overshoe may define apertures through which the footwear is visible.

In embodiments, the completed electrical circuit of the electrostatic discharging, detachable, overshoe may facilitate conducting static electricity. In embodiments, the overshoe may dissipate electricity. In embodiments, the overshoe may conduct electricity collected by the conductive element to an electrically conductive surface with which the overshoe makes contact. In embodiments, a rate of electrical conduction may be determined based on the properties of the skeleton. In embodiments, the properties of the skeleton may include the composition of the material comprising the overshoe. In embodiments, the electrostatic skeleton conductivity may not substantially change when the electrostatic skeleton is compressed.

In embodiments, the electrostatic skeleton may contain nitrile rubber. In embodiments, the electrostatic skeleton may be made of nitrile rubber. In embodiments, the electrostatic skeleton may contain at least one of carbon, silver, carbon black, conductive silicone, polyacetylene, nanopolyacetylene (nanofiber), dissipative vinyl, carbon nanotubes, thermoplastic elastomer and polyurethane.

In embodiments, the electrostatic skeleton may comprise a flexible, cushiony, stretchable material combined with an electrically conductive material. In embodiments, the electrostatic skeleton may comprise a flexible material combined with an electrically conductive material. In embodiments, the electrostatic skeleton may comprise a cushiony material combined with an electrically conductive material. In embodiments, the electrostatic skeleton may comprise a stretchable material combined with an electrically conductive material.

In embodiments, the electrostatic skeleton may contain a thermoplastic elastomer. In embodiments, the electrostatic skeleton may contain polyvinylchloride. In embodiments, the electrostatic skeleton may contain rubber. In embodiments, electrostatic skeleton may contain rubber additives. In embodiments, the overshoe may be electrically resistive. In embodiments, the electrical resistivity may be between 200 thousand and 10 mega ohms.

In embodiments, the electrostatic discharging, detachable, overshoe may further comprise a resistor in series with the conductive element and the electrostatic skeleton. In embodiments, the resistor may have a resistance value of between 1 mega ohm and 10 mega ohms. In embodiments, the resistor may be a current limiting resistor.

In embodiments, the conductive element of the electrostatic discharging, detachable, overshoe may be attached to the electrostatic skeleton by at least one of conductive adhesive, staple, grommet, sewing, and ultrasonic welding.

In embodiments, the electrostatic skeleton may allow for increased traction on surfaces. In embodiments, the increased traction may be due to the oversized heel region. In embodiments, the increased traction may be due to the oversized toe region. In embodiments, the skeleton may provide a coefficient of friction between the footwear and a walking surface of less than or equal to 0.5. In embodiments, the skeleton may provide a coefficient of friction between the footwear and a walking surface of greater than or equal to 0.5. In embodiments, the material on the bottom of the overshoe may provide traction. In embodiments, the tread pattern of the overshoe may provide traction. In embodiments, the skeleton may slip-resistant. In embodiments, the skeleton may be non-slip. In embodiments, the skeleton may be non-skid.

In embodiments, aspects of the overshoe may be substantially unchanged after washing. In embodiments, these aspects may include at least one of coefficient of friction, electrostatic dissipation, electrical resistance, overall size, and flexibility. In embodiments, aspects of the overshoe may be substantially unchanged after machine washing. In embodiments, these aspects may include at least one of coefficient of friction, electrostatic dissipation, electrical resistance, overall size, and flexibility. In embodiments, aspects of the overshoe may be substantially unchanged after autoclaving. In embodiments, these aspects may include at least one of coefficient of friction, electrostatic dissipation, electrical resistance, overall size, and flexibility.

In embodiments, the oversized heel region of the electrostatic discharging, detachable, overshoe may constitute 20% of the bottom surface. In embodiments, the oversized heel region of the electrostatic discharging, detachable, overshoe may constitute 25% of the bottom surface. In embodiments, the oversized heel region of the electrostatic discharging, detachable, overshoe may constitute 30% of the bottom surface. In embodiments, the oversized heel region of the electrostatic discharging, detachable, overshoe may constitute 35% of the bottom surface. In embodiments, the oversized heel region of the electrostatic discharging, detachable, overshoe may constitute 40% of the bottom surface. In embodiments, the oversized heel region of the electrostatic discharging, detachable, overshoe may constitute 45% of the bottom surface. In embodiments, the oversized heel region of the electrostatic discharging, detachable, overshoe may constitute 50% of the bottom surface.

In embodiments, the oversized toe region of the electrostatic discharging, detachable, overshoe may constitute 20% of the bottom surface. In embodiments, the oversized toe region of the electrostatic discharging, detachable, overshoe may constitute 25% of the bottom surface. In embodiments, the oversized toe region of the electrostatic discharging, detachable, overshoe may constitute 30% of the bottom surface. In embodiments, the oversized toe region of the electrostatic discharging, detachable, overshoe may constitute 35% of the bottom surface. In embodiments, the oversized toe region of the electrostatic discharging, detachable, overshoe may constitute 40% of the bottom surface. In embodiments, the oversized toe region of the electrostatic discharging, detachable, overshoe may constitute 45% of the bottom surface. In embodiments, the oversized toe region may constitute 50% of the bottom surface. In embodiments, the oversized toe region of the electrostatic discharging, detachable, overshoe may constitute 45% of the bottom surface and the oversized heel region may constitute 25% of the bottom surface.

In embodiments, the combined oversized heel and toe regions of the electrostatic discharging, detachable, overshoe may constitute more than 90% of the bottom surface. In embodiments, the combined oversized heel and toe regions of the electrostatic discharging, detachable, overshoe may constitute more than 85% of the bottom surface. In embodiments, the combined oversized heel and toe regions of the electrostatic discharging, detachable, overshoe may constitute more than 80% of the bottom surface. In embodiments, the combined oversized heel and toe regions of the electrostatic discharging, detachable, overshoe may constitute more than 75% of the bottom surface. In embodiments, the combined oversized heel and toe regions of the electrostatic discharging, detachable, overshoe may constitute more than 70% of the bottom surface. In embodiments, the combined oversized heel and toe regions of the electrostatic discharging, detachable, overshoe may constitute more than 65% of the bottom surface. In embodiments, the combined oversized heel and toe regions of the electrostatic discharging, detachable, overshoe may constitute more than 60% of the bottom surface. In embodiments, the combined oversized heel and toe regions of the electrostatic discharging, detachable, overshoe may constitute more than 55% of the bottom surface. In embodiments, the combined oversized heel and toe regions of the electrostatic discharging, detachable, overshoe may constitute more than 50% of the bottom surface.

In embodiments, the combined oversized heel and toe regions of the electrostatic discharging, detachable, overshoe may constitute 100% of the bottom surface. In embodiments, the combined oversized heel and toe regions of the electrostatic discharging, detachable, overshoe may constitute up to 100% of the bottom surface. In embodiments, the combined oversized heel and toe regions of the electrostatic discharging, detachable, overshoe together may constitute a solid sole of the overshoe.

In embodiments, the electrostatic skeleton may include an inner cushioned area. In embodiments, the inner cushioned area may comprise a plurality of separated cushioned areas. In embodiments, the plurality of separate areas may be two separate areas. In embodiments, the plurality of separate areas may be three separate areas. In embodiments, the plurality of separate areas may be four separate areas. In embodiments, a portion of the skeleton that connects the toe region to the heel region nay stretches to accommodate various shoe sizes. In embodiments, the portion of the skeleton that connects the toe and heel region may be situated to be located below an arch of the footwear.

In embodiments, the electrostatic skeleton may dissipate a portion of impact forces generated from walking. In embodiments, the electrostatic skeleton may dissipate impact forces between the footwear and a walking surface. In embodiments, the impact forces may be dissipated over an area larger than an impact area. In embodiments, the dissipation area may be substantially equivalent to at least one of the oversized heel region and the oversized toe region.

An electrostatic discharging, detachable, overshoe, may comprise an electrically conductive flexible skeleton for placing over footwear, wherein the skeleton stretches to secure the overshoe on the footwear; and a conductive element situated to facilitate conducting static electricity between a body of a wearer of the footwear and the overshoe. In embodiments, the skeleton may cover substantially all of the footwear outer surface. In embodiments, the skeleton may cover substantially all of the footwear front, back, and sides, while leaving substantially all of the footwear top exposed. In embodiments, the skeleton may cover portions of the footwear front, back, and sides. In embodiments, the skeleton may comprise a series of bonded, narrow elongated segments. In embodiments, the skeleton may be molded in a single piece. In embodiments, the skeleton may define apertures through which the footwear is visible.

In embodiments, the overshoe may dissipate electricity. In embodiments, the overshoe may conduct electricity collected by the conductive element to an electrically conductive surface with which the overshoe makes contact. In embodiments, a rate of electrical conduction may be determined based on the properties of the skeleton. In embodiments, these properties may include the composition of the material comprising the overshoe. In embodiments, the electrostatic skeleton conductivity may not substantially change when the electrostatic skeleton is compressed.

In embodiments, the electrostatic skeleton may contain nitrile rubber. In embodiments, the electrostatic skeleton may be made of nitrile rubber. In embodiments, the electrostatic skeleton may contain at least one of carbon, silver, carbon black, conductive silicone, polyacetylene, nanopolyacetylene (nanofiber), dissipative vinyl, carbon nanotubes, thermoplastic elastomer and polyurethane.

In embodiments, the electrostatic skeleton may comprises a flexible, cushiony, stretchable material combined with an electrically conductive material. In embodiments, the electrostatic skeleton may comprise a flexible material combined with an electrically conductive material. In embodiments, the electrostatic skeleton may comprise a cushiony material combined with an electrically conductive material. In embodiments, the electrostatic skeleton may comprise a stretchable material combined with an electrically conductive material. In embodiments, the electrostatic skeleton may contain thermoplastic elastomer. In embodiments, the electrostatic skeleton may contain polyvinylchloride. In embodiments, the electrostatic skeleton may contain rubber. In embodiments, the electrostatic skeleton may contain rubber additives.

In embodiments, the overshoe may be electrically resistive. In embodiments, the electrical resistivity may be between 200 thousand and 10 mega ohms. In embodiments, the electrostatic discharging, detachable, overshoe may further comprise a resistor in series with the conductive element and the electrostatic skeleton. In embodiments, the resistor may have a resistance value of between 1 mega ohm and 10 mega ohms. In embodiments, the resistor may be a current limiting resistor.

In embodiments, the conductive element of the electrostatic discharging, detachable, overshoe may be attached to the electrostatic skeleton by at least one of conductive adhesive, staple, grommet, sewing, and ultrasonic welding.

In embodiments, the electrostatic skeleton may allow for increased traction on surfaces. In embodiments, the increased traction may be due to an oversized heel region. In embodiments, the increased traction may be due to an oversized toe region. In embodiments, the skeleton may provide a coefficient of friction between the footwear and a walking surface of less than or equal to 0.5. In embodiments, the skeleton may provide a coefficient of friction between the footwear and a walking surface of greater than or equal to 0.5. In embodiments, the material on the bottom of the overshoe may provide traction. In embodiments, the tread pattern of the overshoe may provide traction. In embodiments, the skeleton may be slip-resistant. In embodiments, the skeleton may be non-slip. In embodiments, the skeleton may be non-skid.

In embodiments, aspects of the overshoe may be substantially unchanged after washing. In embodiments, these aspects may include at least one of coefficient of friction, electrostatic dissipation, electrical resistance, overall size, and flexibility. In embodiments, aspects of the overshoe may be substantially unchanged after machine washing. In embodiments, these aspects may include at least one of coefficient of friction, electrostatic dissipation, electrical resistance, overall size, and flexibility. In embodiments, aspects of the overshoe may be substantially unchanged after autoclaving. In embodiments, these aspects may include at least one of coefficient of friction, electrostatic dissipation, electrical resistance, overall size, and flexibility.

In embodiments, the electrostatic skeleton may include an inner cushioned area. In embodiments, the inner cushioned area may comprise a plurality of separated cushioned areas. In embodiments, the plurality of separate areas may be two separate areas. In embodiments, the plurality of separate areas may be three separate areas. In embodiments, the plurality of separate areas may be four separate areas.

In embodiments, the electrostatic skeleton may dissipate a portion of impact forces generated from walking. In embodiments, the electrostatic skeleton may dissipate impact forces between the footwear and a walking surface. In embodiments, the impact forces may be dissipated over an area larger than an impact area. In embodiments, the dissipation area may be substantially equivalent to at least one of the oversized heel region and the oversized toe region.

These and other systems, methods, objects, features, and advantages of the present invention will be apparent to those skilled in the art from the following detailed description of the preferred embodiment and the drawings. All documents mentioned herein are hereby incorporated in their entirety by reference.

BRIEF DESCRIPTION OF THE FIGURES

The invention and the following detailed description of certain embodiments thereof may be understood by reference to the following figures.

DETAILED DESCRIPTION

Figure 1:
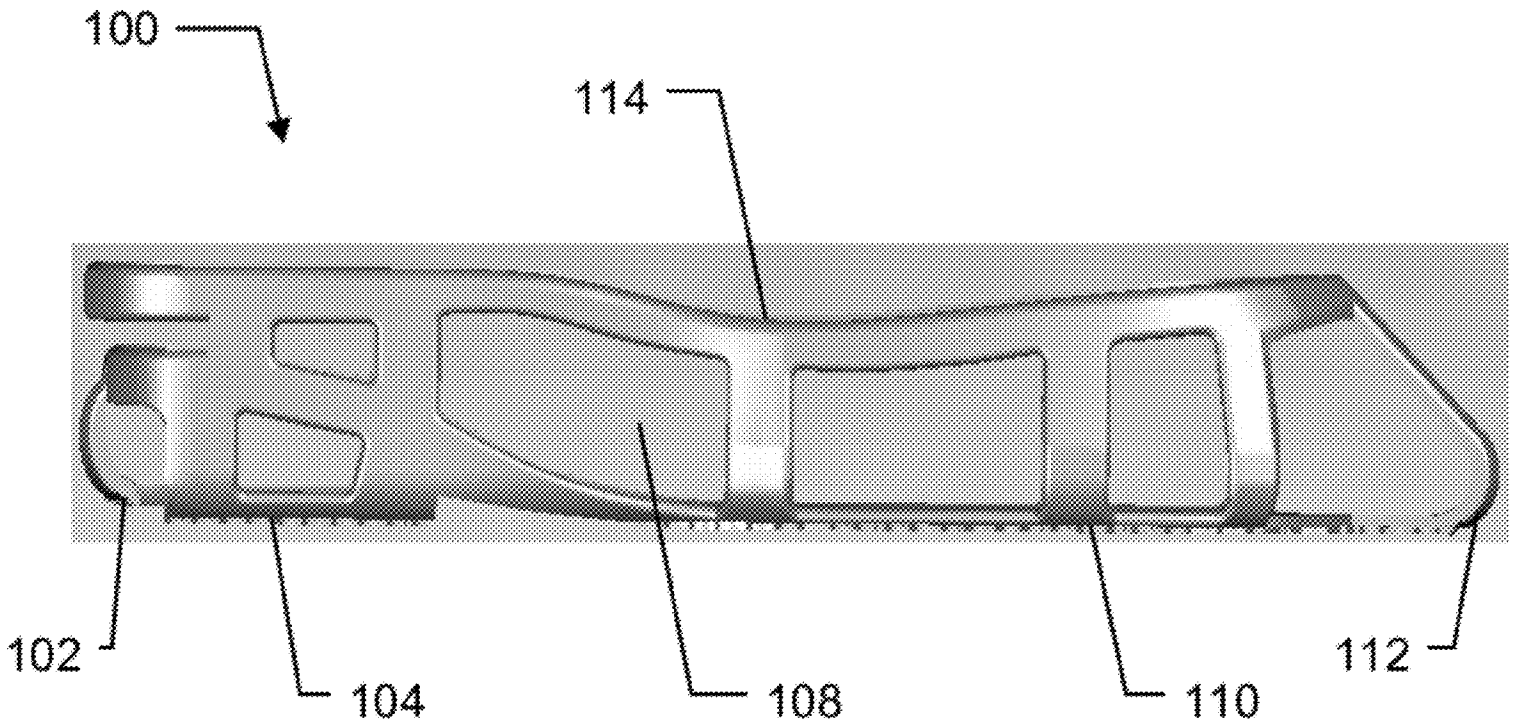
FIG. 1 depicts a side view of the overshoe.

An electrostatically dissipative overshoe may be configured as an upper skeleton or flexible frame molded with a slip-resistant, static dissipative sole. The upper skeleton may stretch over footwear so that at least a top portion of the upper skeleton makes tight fitting contact with an upper portion of the footwear, thereby securing the overshoe in place so that a sole of the overshoe fits closely against a sole of the footwear.

The sole of the overshoe may include heel and toe regions connected by intermediate extensions of the sole. The heel and toe regions may be oversized so that a relatively large portion of the footwear heel and toe are covered by the overshoe. The intermediate extensions of the sole may define a gap between the heel and toe regions of the sole so that flexing of the footwear sole does not cause the sole of the overshoe to buckle or bunch up.

The overshoe may facilitate conducting static electricity from a body of a wearer by providing a conductive strap or ribbon that is attached to the overshoe and may be placed by the wearer in contact with the wearer's body, such as inside a sock. The conductive strap may be an electrically conductive element that may be made of various materials that are comfortable when placed against the wearer's body. The various materials of the conductive strap may include composite materials that combine comfort and electrical conductivity with extreme flexibility, such as to allow placement under the arch of a foot of the wearer. The conductive strap or ribbon may be molded to the overshoe and/or associated with the overshoe using one or more of a conductive adhesive, staple, grommet, sewing, and ultrasonic welding.

The overshoe may be a skeleton or open frame as described herein. Alternatively, the overshoe may include closed portions connected by intermediate portions, such as a closed toe portion that wraps around the toe area of a wearer's footwear connected through intermediate portions to a closed heel area that wraps behind and under a heel of the wearer's footwear. Alternatively, the upper portion of the overshoe may be entirely closed, or may be closed with small openings, such as for ventilation, and a single large opening to allow the wearer to slip the overshoe over footwear. The opening in the upper portion of the overshoe may expose a substantial portion of the footwear upper similarly to a slip-on rain shoe. The overshoe may be flexible and stretch enough to fit over flat shoes such as loafers as well as fit around large shoes such as work boots. A skeleton or open frame upper portion of the overshoe may facilitate a secure and reliable fit over a wide range of shoe sizes, types, and styles.

Because the overshoe may be stretched to fit over footwear and may securely hold to the footwear, buckles, straps, closures, elastic bands, Velcro and the like are not needed to effectively use the overshoe. The stretching properties of the overshoe may create a tension fit binding system.

The overshoe may be molded. It may be molded as a single piece so that the sole and the upper portion of the overshoe are molded in a single multipart mold. Alternatively, the upper portion and sole may be molded independently and bonded together at the end of molding or afterward. In other embodiments, the overshoe may be molded in any number of pieces which may be bonded together. The conductive strap may be attached during the molding process, effectively molding the conductive strap to the overshoe.

The overshoe may conduct electricity. The rate of conduction may be affected by the material composition of the overshoe. A dissipative material, such as nitrile rubber or polyurethane may be used to provide a dissipative, conductive conduit from the conductive strap to the sole of the overshoe thereby facilitating transmission of electro-static charge from the body of a wearer to a grounded surface, such as a grounded floor. The overshoe may be a composite of materials that may include nitrile rubber, polyurethane, carbon, carbon black, silver, conductive silicone, polyacetylene, nano-polyacetylene, dissipative vinyl, carbon nanotubes, thermoplastic elastomer and the like. In embodiments, the materials may be mixed with one or more electrostatic dissipating compounds. Substantially any material or combination of materials that is one or more of flexible, provides cushioning, stretches over footwear, dissipates electronic static charge, and moldable may be potential material for the overshoe. The composite of materials may be corrosion resistant. The composite of materials may resist chemical changes when exposed to certain chemical agents. In embodiments, chemical agents may include industrial solvents and chemicals used in manufacturing processes.

When in use, the overshoe may be stretched, causing material elongation, and the sole may be compressed from the weight of a wearer. The dissipative properties of the overshoe may not substantially change due to stretching or compression. The dissipative measure of the overshoe may be a sheet resistance in the range of $10^4$ ohms/square to $10^{12}$ ohms/square. With a sheet resistance in this range, the overshoe may provide a measure of safety for the wearer that is equal to or better than a typical 1M ohm series resistor. Therefore the overshoe may be available without a dedicated series resistor in the electrical conduction path from a wearer's body, through the conductive strap, through the overshoe, and to a conductive, electrically grounded surface. In an alternate embodiment, a safety resistor, such as a 1M ohm resistor may be placed in the electrical conduction path to further safeguard the wearer from receiving an electrical shock if the overshoe makes contact with a high energy electrical source.

The overshoe may facilitate slip-resistance when worn over footwear. Materials comprising the overshoe, such as, for example, nitrile rubber, may provide improved friction between a wearer's footwear and a surface on which the footwear is being used. Other materials may also provide improved friction. The overshoe may be designated as meeting OSHA, ANSI, or military slip-resistant requirements, such as a coefficient of friction of 0.5 or greater. The overshoe may be characterized as non-slip or non-skid. In embodiments, the overshoe may facilitate increased traction. In embodiments, the increased traction may result from the tread pattern on the upper surface of the overshoe that contacts the wearer's footwear and/or the tread pattern on the lower surface of the overshoe that contacts the ground.

The overshoe may gain slip-resistance from the selection of the material, the snug fit to the footwear, the tread design, and the like. Nitrile rubber may provide an acceptable coefficient of friction. The tread design may include a variety of tread heights to further facilitate achieving slip-resistance on a variety of surfaces. The tread design may include multidirectional channels that allow greater surface area contact between a walking surface and the overshoe as a result of at least the tread portion of the sole flexing and compressing.

The overshoe may be washable using a conventional clothes washing machine or an autoclave. In embodiments, the overshoe may be washable by hand and other washing methods. Various aspects of the overshoe may be unaffected by washing or the autoclave (e.g. the coefficient of friction, electrostatic dissipation, overall size, flexibility, and the like).

The overshoe, as described herein, may include an oversized toe region and may also or alternatively include an oversized heel area. The heel region may cover up a portion of the sole of the footwear and may range from as little of 20% coverage to more than 100% coverage. Similarly the toe region may cover as little as 20% of a wearer's footwear sole and may range to more than 100% coverage of the wearer's footwear sole. The opening between the toe region and the heel region may be eliminated when coverage of either the heel region, toe region, or their combination is 100% or more of the footwear sole.

Another advantage of the overshoe may include standing or walking comfort for the wearer. The overshoe may be constructed of material that provides cushioning. The cushioning may be based at least in part on a thickness of the heel and/or toe region of the sole of the overshoe. The thickness of the overshoe sole may range from a few millimeters to 4 or more millimeters. Additionally the thickness may or may not be uniform throughout the sole. Key support areas, such as under the ball of the foot, or portions of the heel may be constructed thicker than other portions of the sole. These key support areas may be part of one or more inner cushioned areas of the electrostatic skeleton. Other inner cushioned areas may include skeleton portions along the back of the heel and over the toes. Because nitrile rubber provides a natural flexibility with reduced weight and otherwise facilitates the other features and benefits of the overshoe, it may be used in the construction of the skeleton, sole, and inner cushioned areas. Ergonomically designed cushioned areas may also reduce stress related to standing or walking. Therefore an overshoe with cushioned areas may provide ergonomic relief to the wearer and may reduce stress on the feet, legs, and back of the wearer. By cushioning and dissipating impact forces (e.g. from walking), the overshoe may provide the herein described ergonomic benefits. In embodiments, the ergonomic aspects of the overshoe may result from the materials composing the overshoe. In embodiments, the straps of the overshoe that connect the heel to the forefoot may result in ergonomic properties. In embodiments, the ergonomic properties of the overshoe may be independent from the electrostatic properties of the overshoe.

The overshoe may be used in any application and/or market where electrostatic dissipation is desired and/or necessary. The overshoe may be used in any application anywhere in the world. In an embodiment, the overshoe may be used in the manufacture and/or repair of electronics. In embodiments, the overshoe may be used in an application where a shock or spark may result in a short circuit or other damage. In an embodiment, the overshoe may be used in an application where the potential for combustion exists. In embodiments, such applications may include petroleum refineries, propane/LP plants, munitions factories, and the like. The overshoe may prevent a static discharge which may start a combustion event.

In a specific embodiment, the overshoe may be used in connection with high speed manufacturing processes, which may generate static electricity, such as for plastics, fabrics and the like. For example, the high speed manufacturing process may result in the production of pharmaceutical plastics, such as for plastic syringes, fluid bags, bottles and the like. In another example, the high speed manufacturing process may result in the production of fabrics, such as fabrics for clothes, commercial applications and the like. In another embodiment the overshoe may be used in web manufacturing and/or process manufacturing.

The overshoe may be further understood by the following descriptions of the figures.

FIG. 1 depicts a side view of an open frame configuration of the overshoe with a center heel band. The overshoe 100 includes a heel sole portion 104, a toe sole portion 110, a toe band 112, a heel band 102, and openings 108 defined by the frame or skeletal portion of the upper overshoe 114. The over shoe heel band 102 and the toe band 112 facilitate securely capturing the footwear of the wearer so that both the heel and toe remain captured during normal activity such as walking. In this configuration, the upper portion of the overshoe 114 is an open frame that may be flexible and comfortable to wear while providing light weight and secure attachment to footwear.

Figure 2:
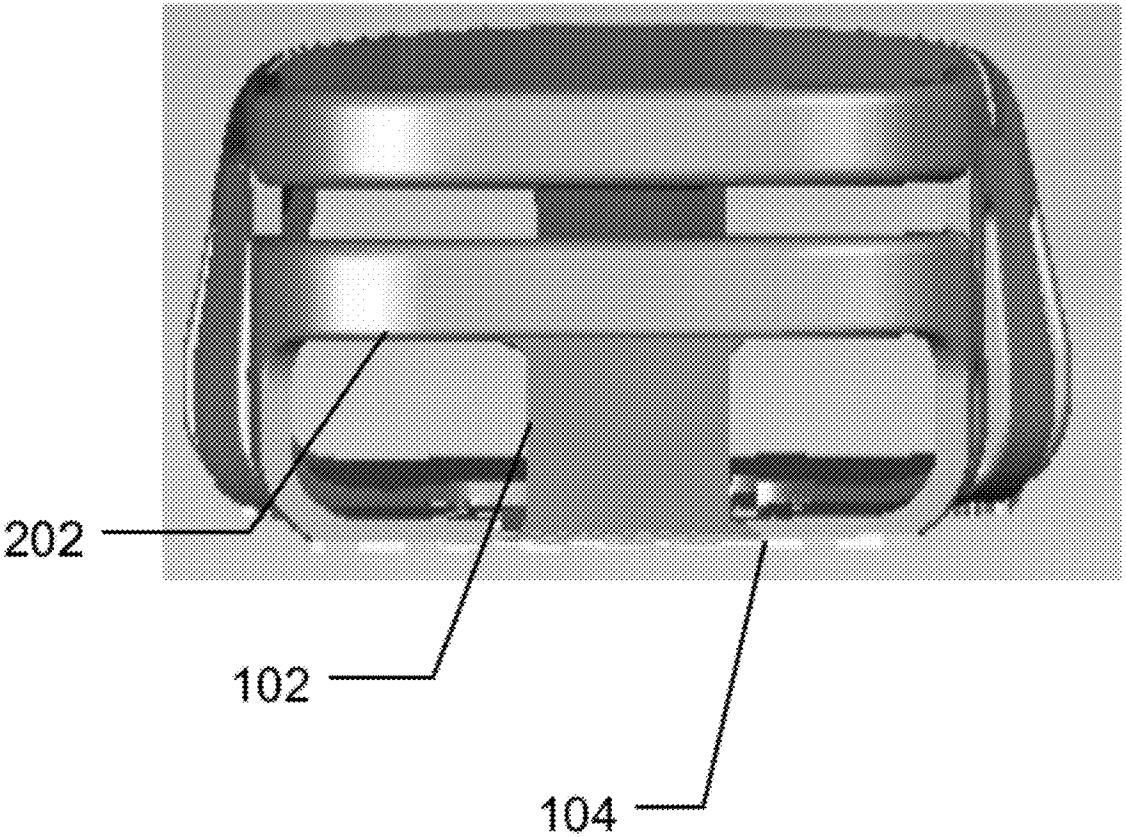
FIG. 2 depicts a rear view of the overshoe.

FIG. 2 depicts a heel view of the overshoe depicted in FIG. 1. In FIG. 2, the heel band 102 is plainly visible. With the heel band 102 in place, the heel lower wrap strap 202 is maintained in relationship to the heel sole portion 104 by the heel band 102.

Figure 3:
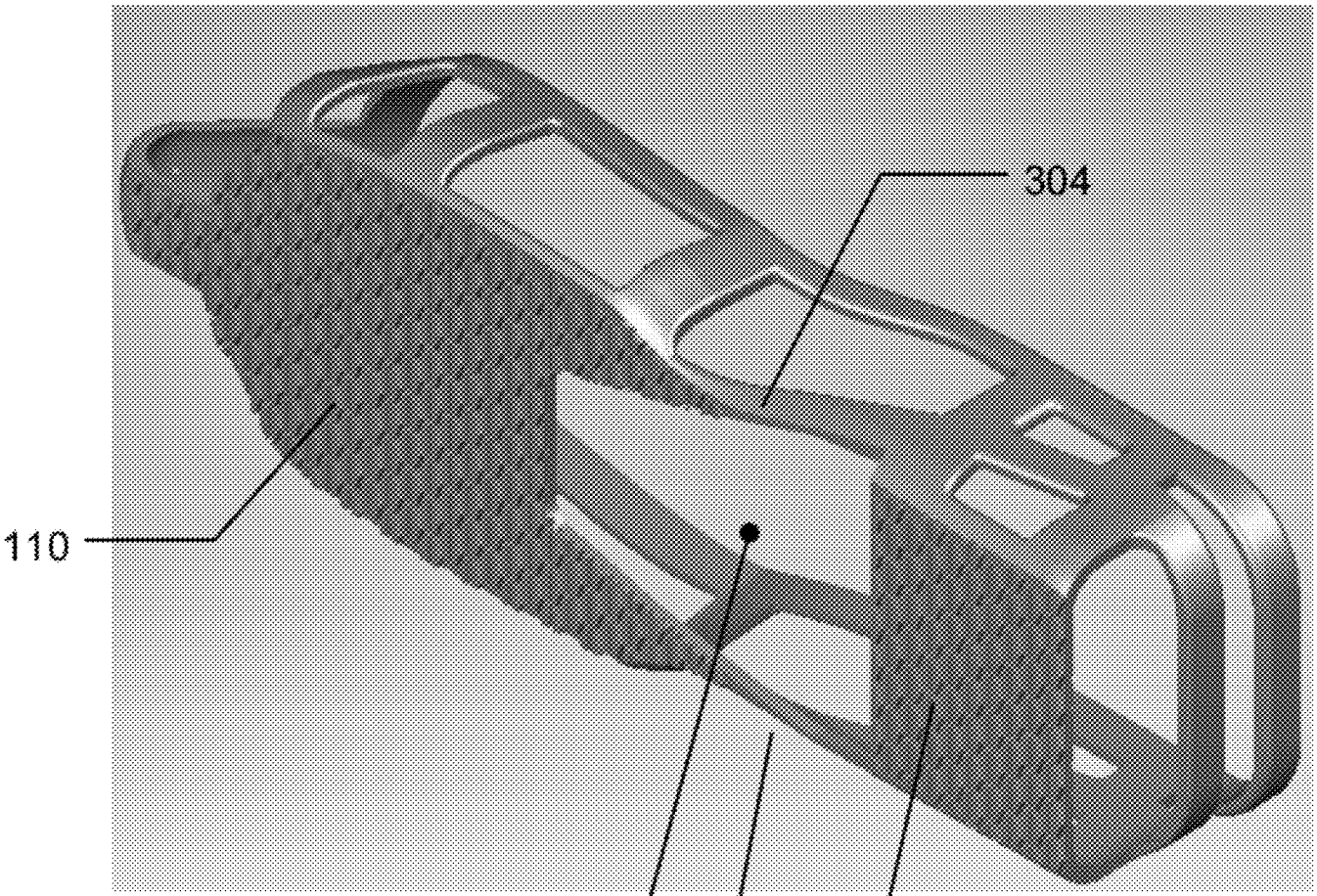
FIG. 3 depicts a perspective bottom facing view of an embodiment of the overshoe.

FIG. 3 depicts a bottom facing perspective view of an embodiment of the overshoe that does not include the heel band. In FIG. 3, the relative size and positioning of the heel region 104 and the toe region 110 is shown along with the opening 302 between the heel region 104 and the toe region 110. FIG. 3 also shows the intermediate sole portions (304 and 308) connecting the heel portion 104 to the toe portion 110.

Figure 4:
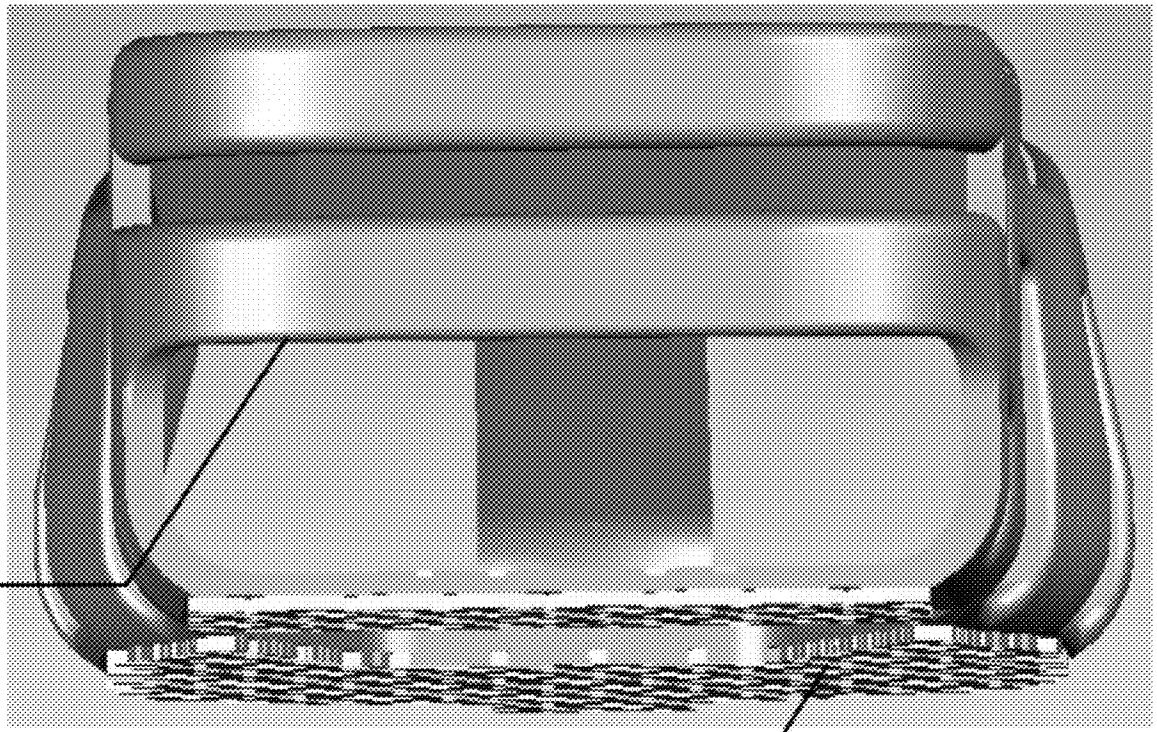
FIG. 4 depicts a rear view of the overshoe of FIG. 3.

FIG. 4 depicts a rear heel view of an embodiment of the overshoe without the heel strap. In this figure the heel wrap 202 is shown without a direct connection to the heel sole portion 104.

Figure 5:
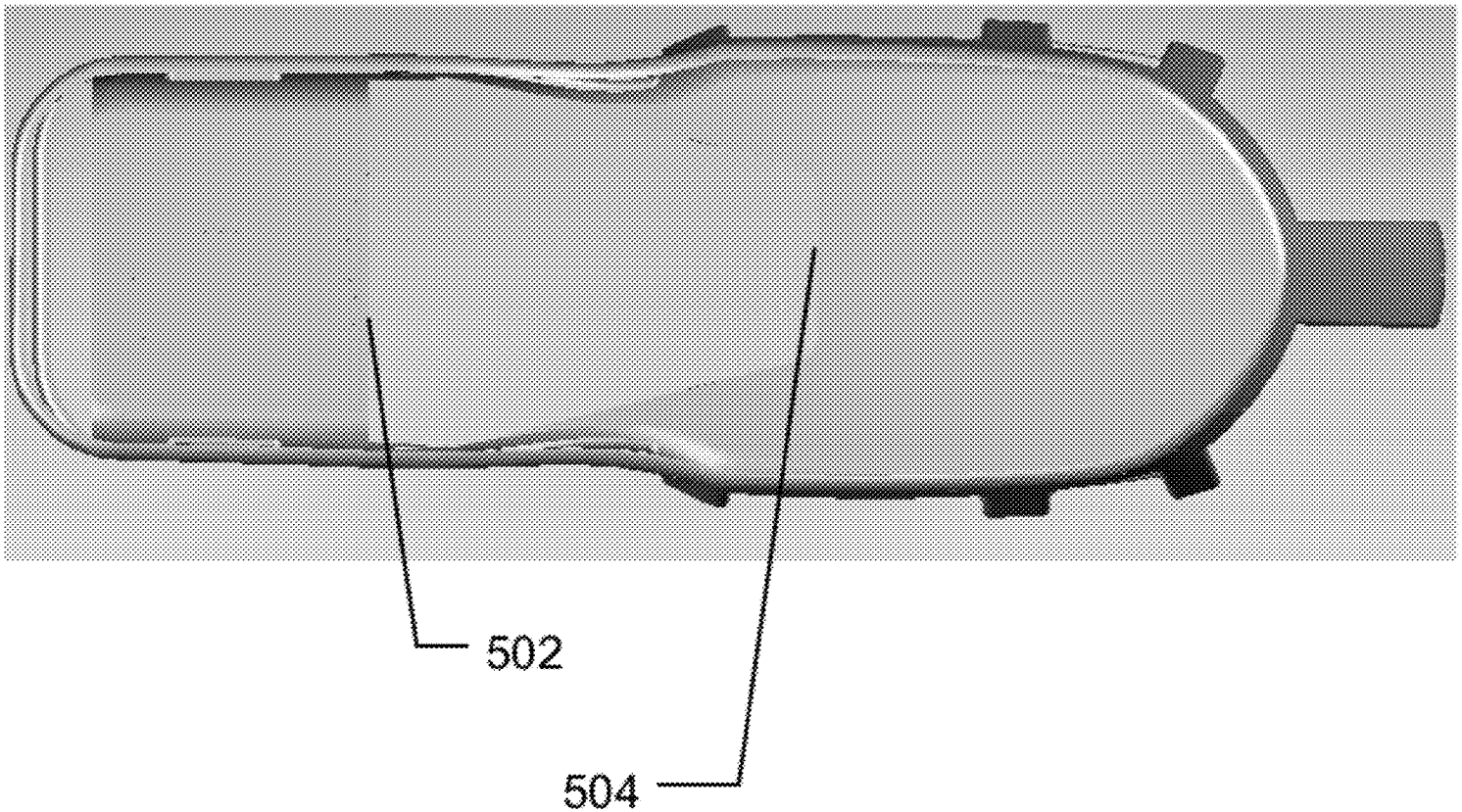
FIG. 5 depicts a top view of the overshoe of FIG. 3.

FIG. 5 depicts a top view of the overshoe. In FIG. 5, the heel portion insole 502 and the toe portion insole 504 are shown. The heel 502 and toe 504 insole is directly opposite the heel 104 and toe 110 portions of the sole.

Figure 6:
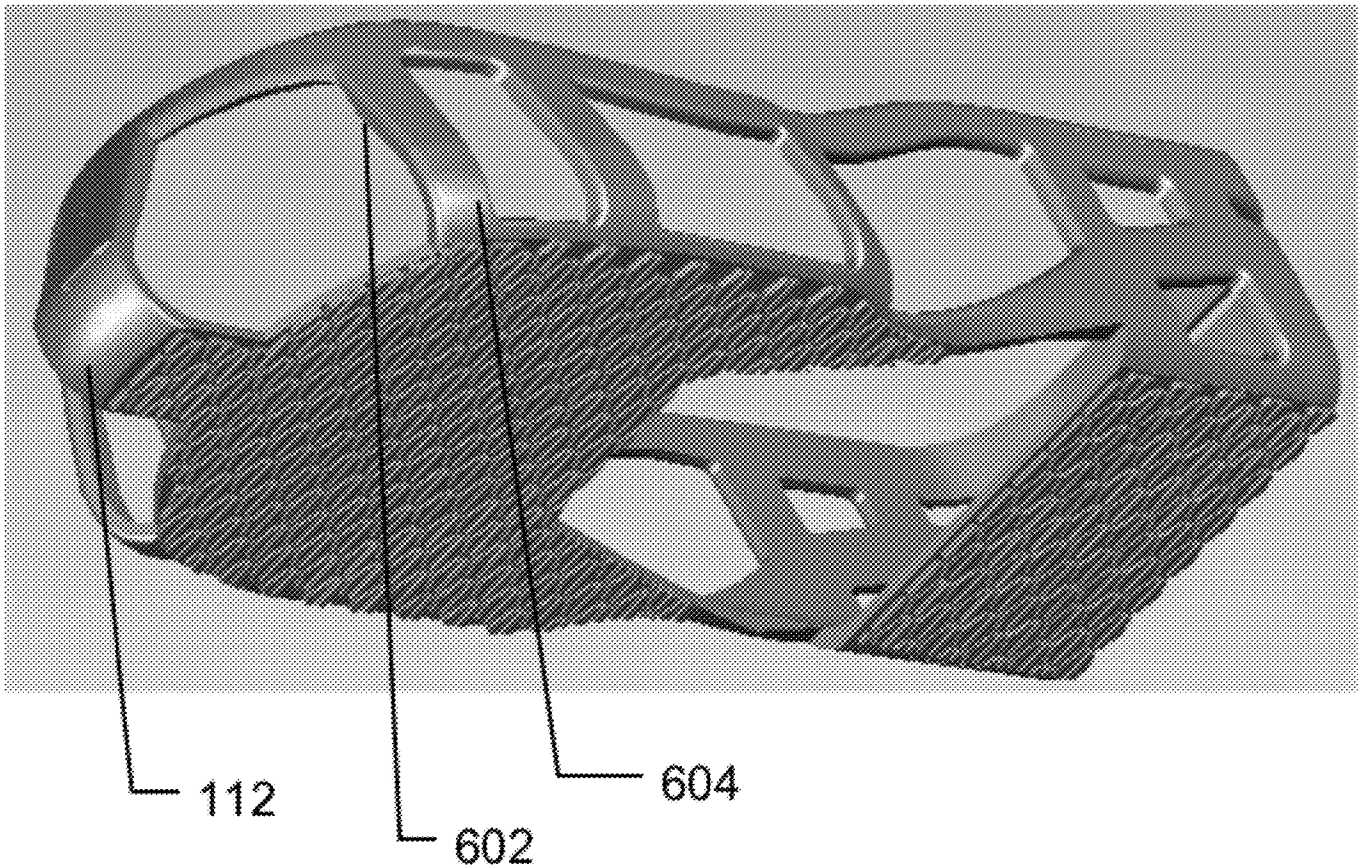
FIG. 6 depicts an alternate perspective view of the overshoe of FIG. 3.

FIG. 6 depicts a sole facing perspective view of the overshoe. This figure provides a clear view of the toe band 102. In this view, the vertical members 602 of the upper skeleton have a visible curve 604 near the joining point with the toe portion 110. This curve facilitates positioning the toe portion 110 evenly under the toe portion of the wearer's footwear. It also facilitates keeping the skeleton firmly against the footwear as the top portion of the upper skeleton stretches over the footwear.

Figure 7:
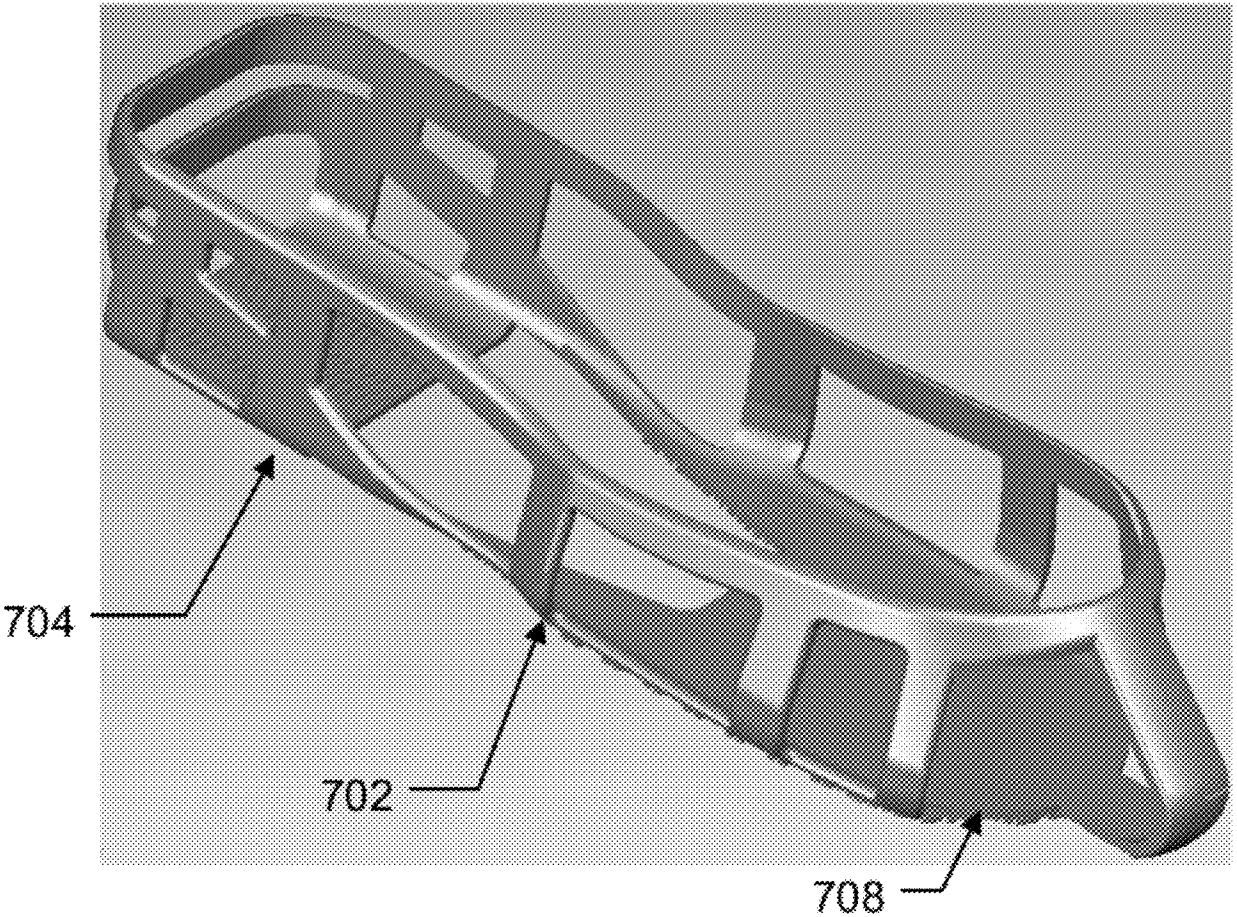
FIG. 7 depicts a perspective top facing view of an overshoe.

FIG. 7 depicts a top perspective view of the overshoe. In this view the upper skeleton is seen as having a contour similar to footwear. It is widest around the mid foot 702, narrows toward the heel 704, and narrower still in the toe area 708.

Figure 8:
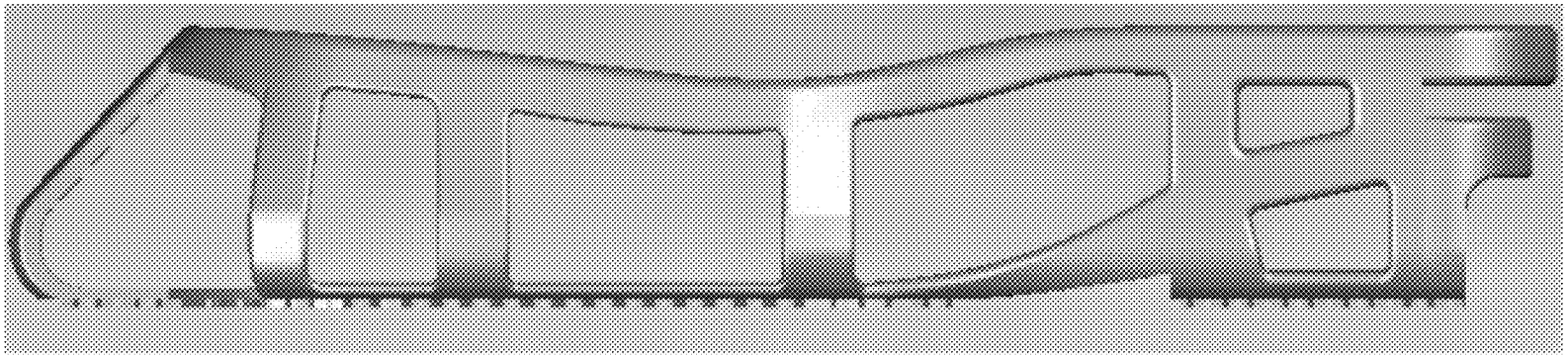
FIG. 8 depicts a side view of the overshoe of FIG. 7.

FIG. 8 depicts a side view of the overshoe without the heel band 102. Features such as the heel and toe tread areas, the toe band, and the upper portion vertical members are visible.

Figure 9A:
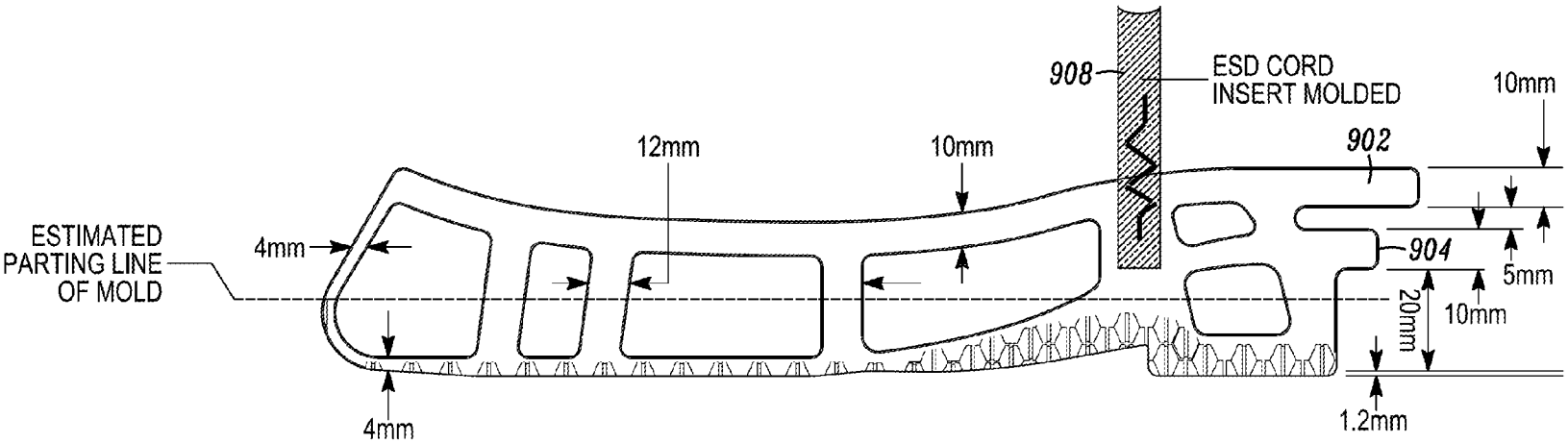
FIGS. 9A and 9B depict side views of the overshoe as mechanical engineering drawings.
Figure 9B:
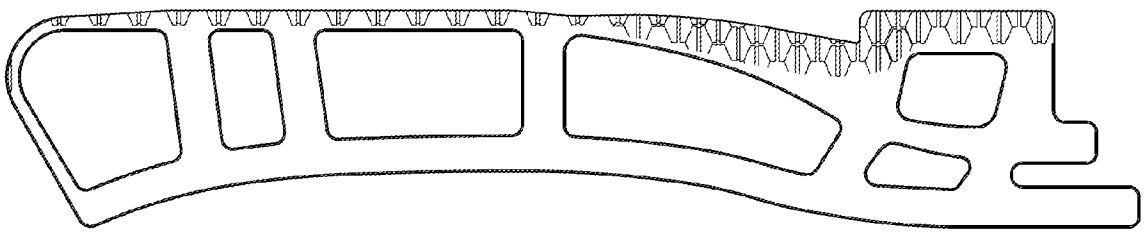

FIGS. 9A and 9B depict orthogonal views of engineering drawings of an embodiment of the overshoe with various dimensions that may apply to the embodiment. The dimensions in this figure are not meant to be limiting, but rather identify one embodiment. In this view, the upper heel wrap 902 extends further than the lower heel wrap 904. This may facilitate stretching the overshoe over footwear. One method for fitting the overshoe over footwear is to engage the toe of the footwear in the toe of the overshoe and stretch the overshoe by tugging on the upper heel wrap 902 until the lower heel wrap 904 is securely on the footwear heel and the overshoe sole is in good contact with the sole of the footwear. In embodiments, the overshoe may be associated with a conductive strap or ribbon 908 that is attached to the overshoe and may be placed by the wearer in contact with the wearer's body. The conductive strap or ribbon 908 may be molded into the overshoe in such a manner to allow for an electric circuit to be completed.

Figure 10:
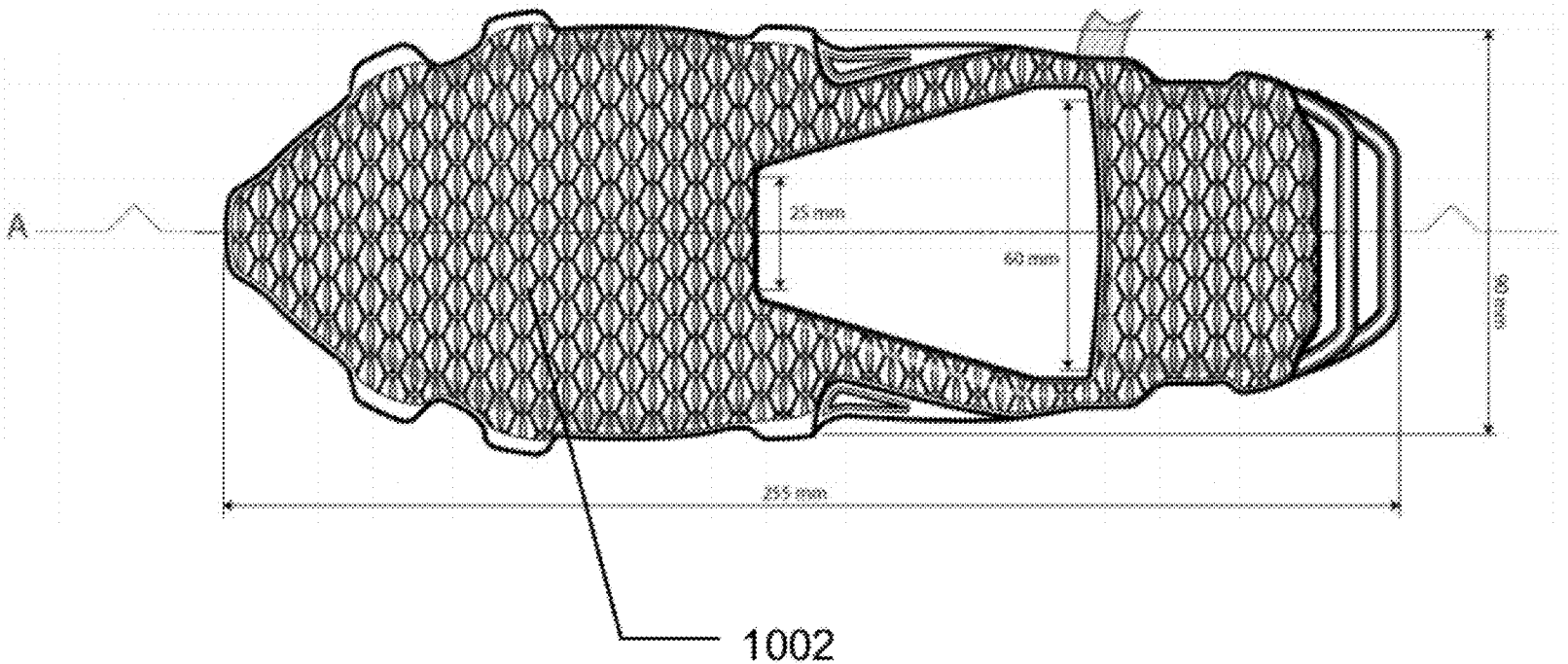
FIG. 10 depicts a bottom facing planar view of the overshoe.

FIG. 10 depicts the bottom of the overshoe and includes a general view of the tread pattern 1002, along with various exemplary dimensions. The dimensions in this figure are not meant to be limiting, but rather identify one embodiment.

Figure 11:
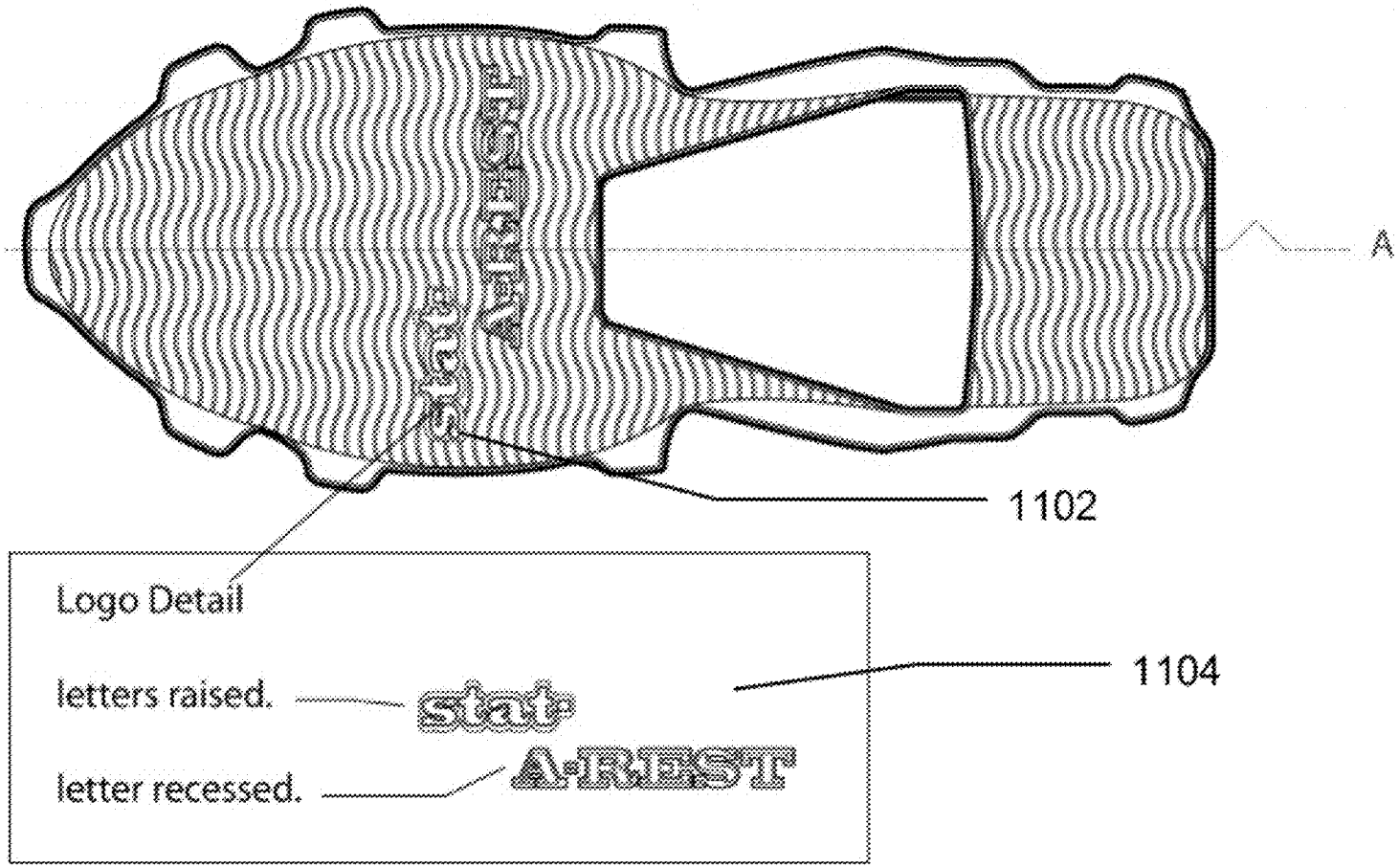
FIG. 11 depicts a detail of a logo formed into the bottom of the overshoe.

FIG. 11 depicts the bottom of the overshoe with a logo. The alternate tread pattern 1102 and logo details 1104 are included in this exemplary embodiment. While a specific logo is depicted in this figure, any other logo, symbol, phrase or art, or tread pattern, may be included.

Figure 12:
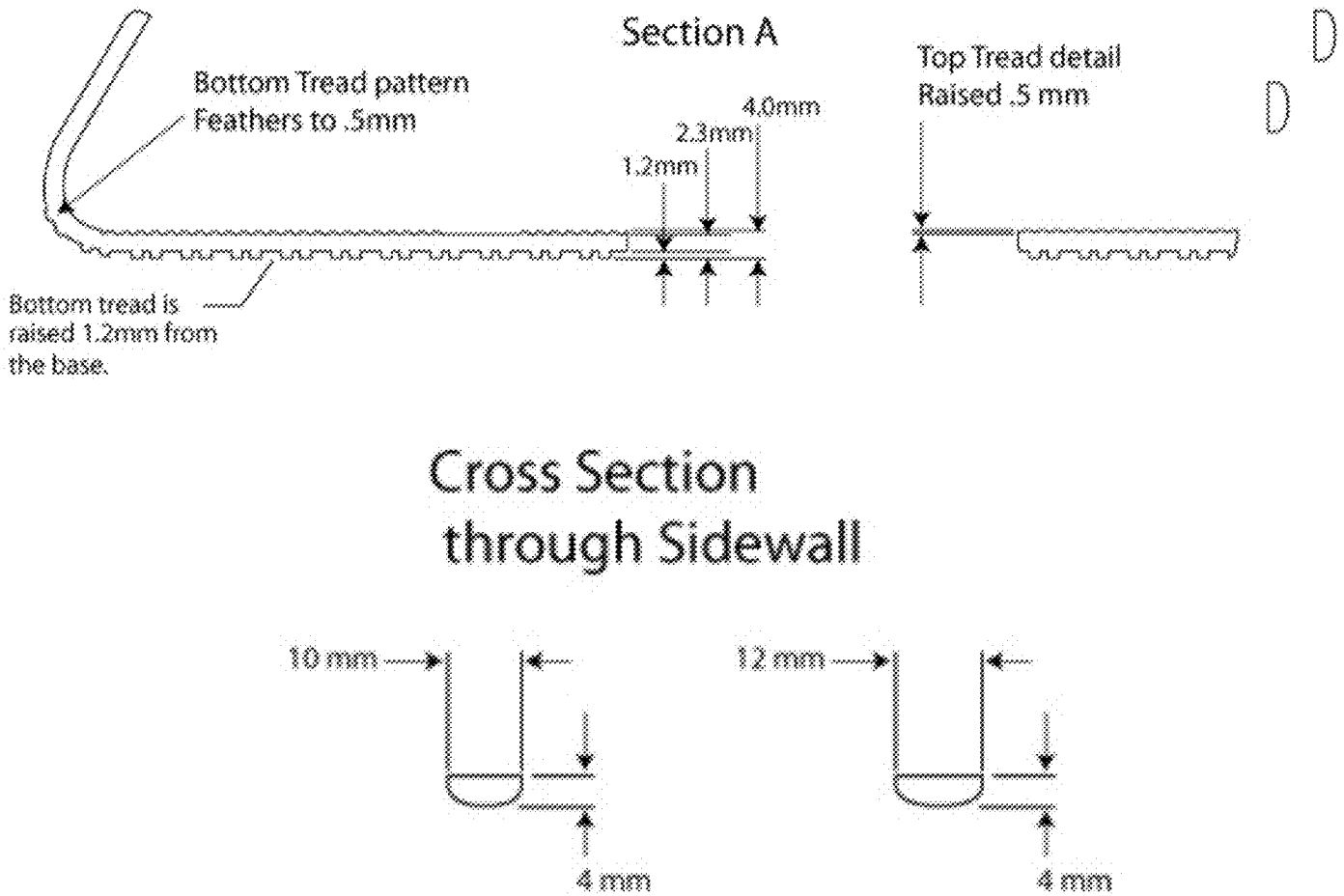
FIG. 12 depicts two cross section views of the overshoe.
Figure 13:
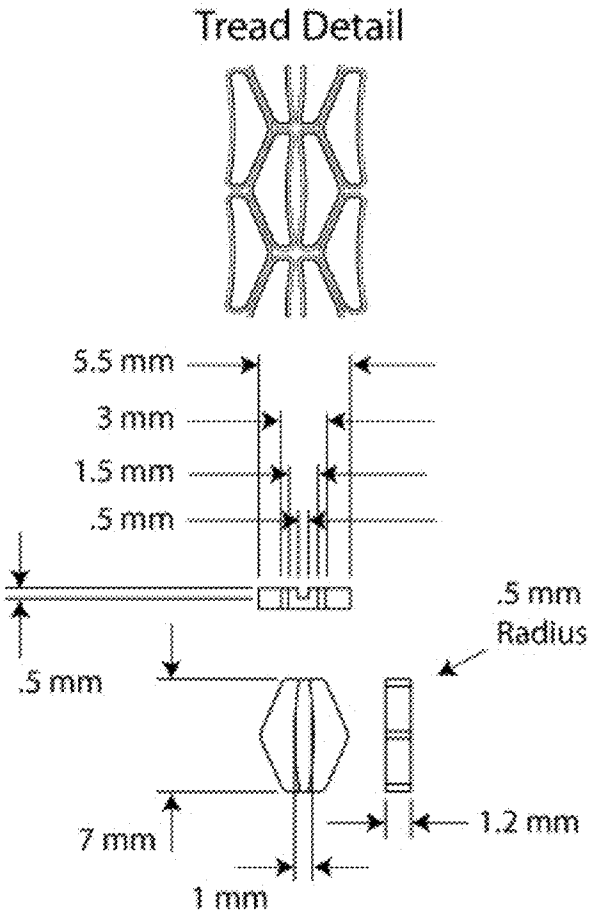
FIG. 13 depicts a detail view of a tread pattern.

FIG. 12 depicts cross sections of portions of the overshoe. The dimensions included in FIG. 12 are only examples for a particular embodiment of the overshoe. FIG. 13 depicts details of tread patterns for treads that may be molded into the overshoe.

Figure 14:
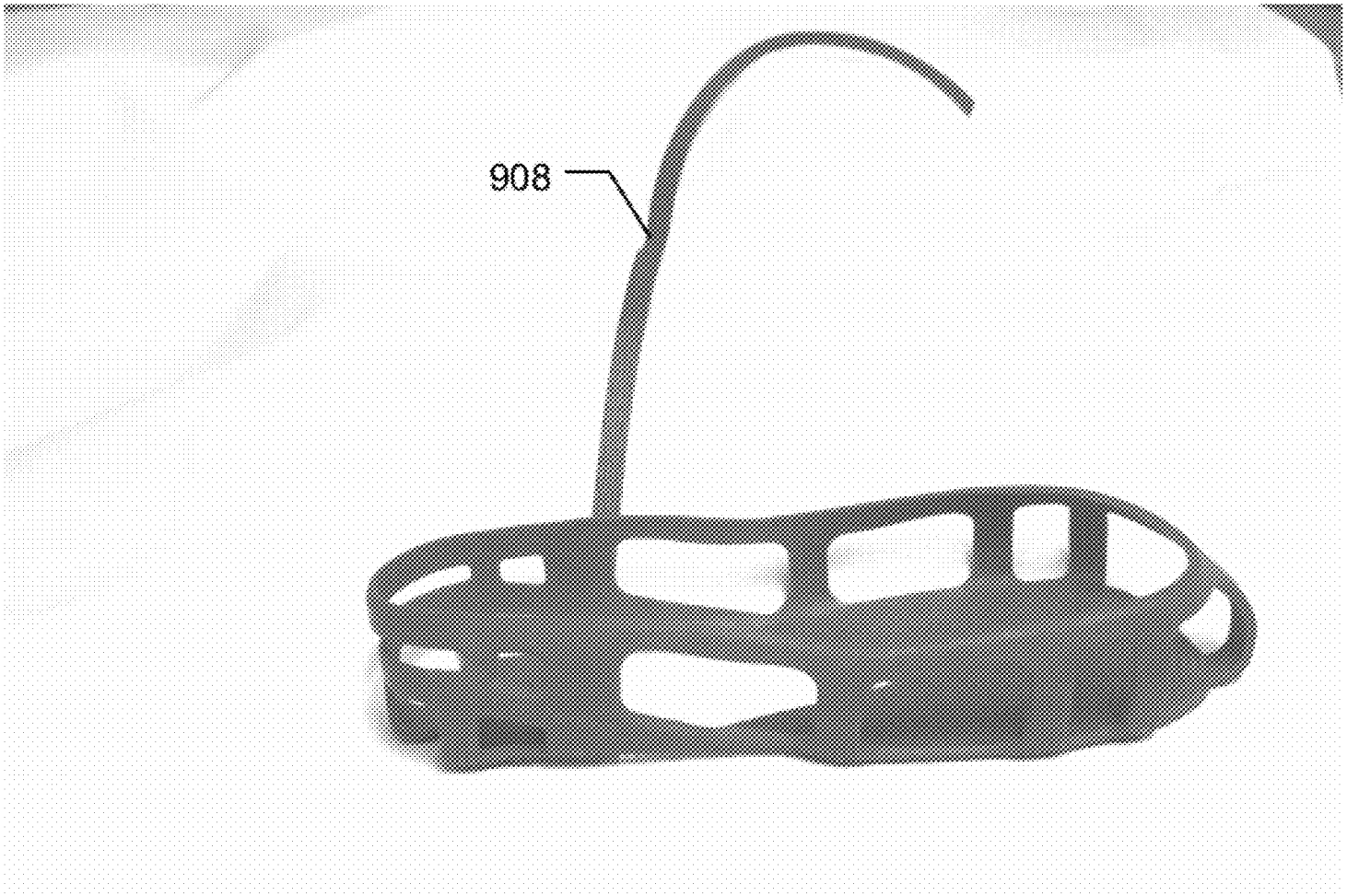
FIG. 14 depicts an oblique side view of a three-dimensional representation of an embodiment of the overshoe.
Figure 15:
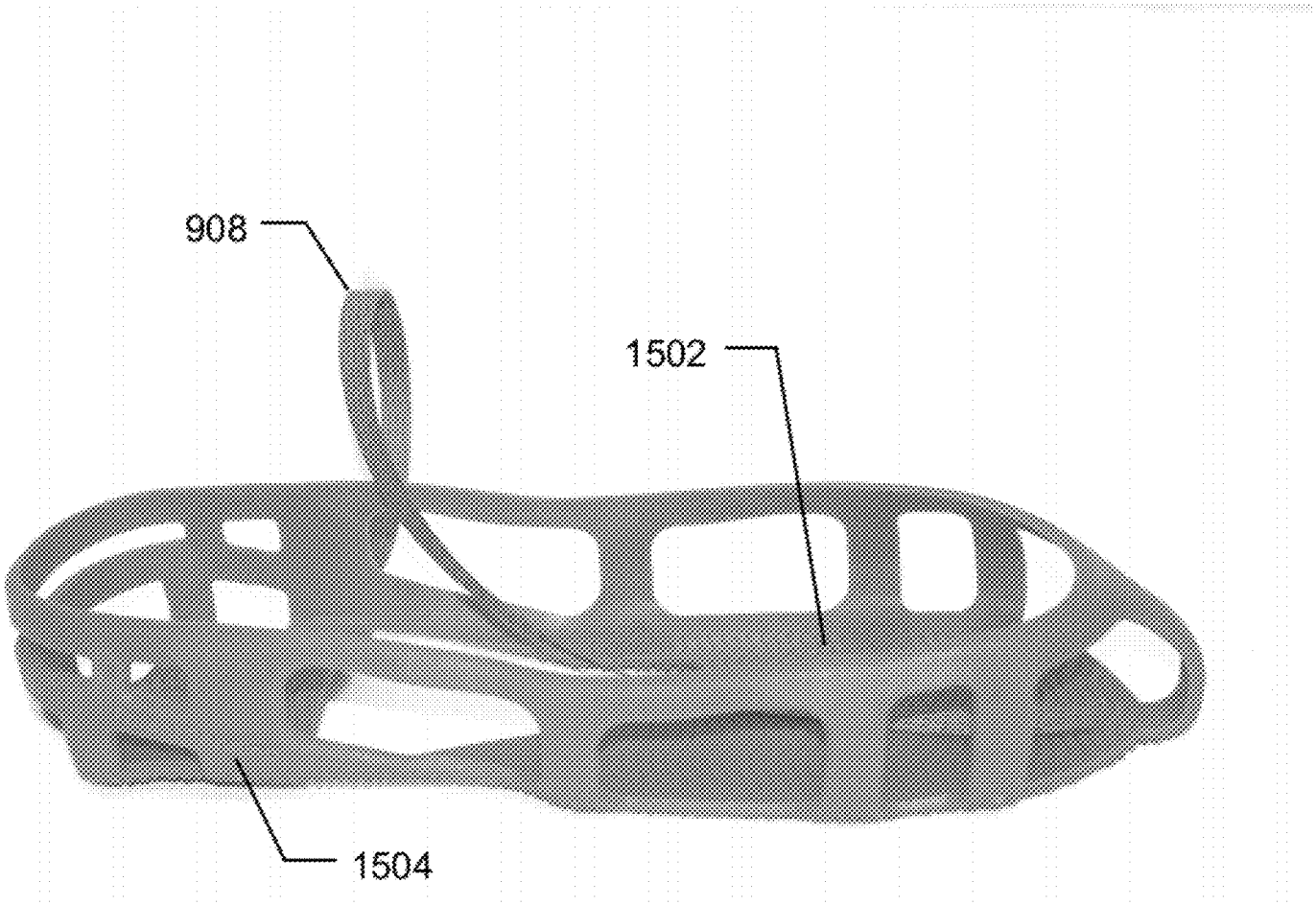
FIG. 15 depicts an alternative oblique side view of a three-dimensional representation of an embodiment of the overshoe.

FIG. 14 depicts an oblique side view of a three-dimensional representation of an embodiment of the overshoe, including a conductive strap or ribbon 908 that is attached to the overshoe. FIG. 15 depicts an alternative oblique side view of a three-dimensional representation of an embodiment of the overshoe, including a conductive strap or ribbon 908 that is attached to the overshoe. In embodiments, the overshoe may include a tread pattern on the surface that comes into contact with the footwear of the wearer 1502. The tread pattern 1502 may increase the coefficient of friction between the footwear of the wearer and the overshoe. In embodiments, the overshoe may include a patent pending notice 1504 or other notice molded directly as part of the overshoe, or provided in another manner.

Figure 16:
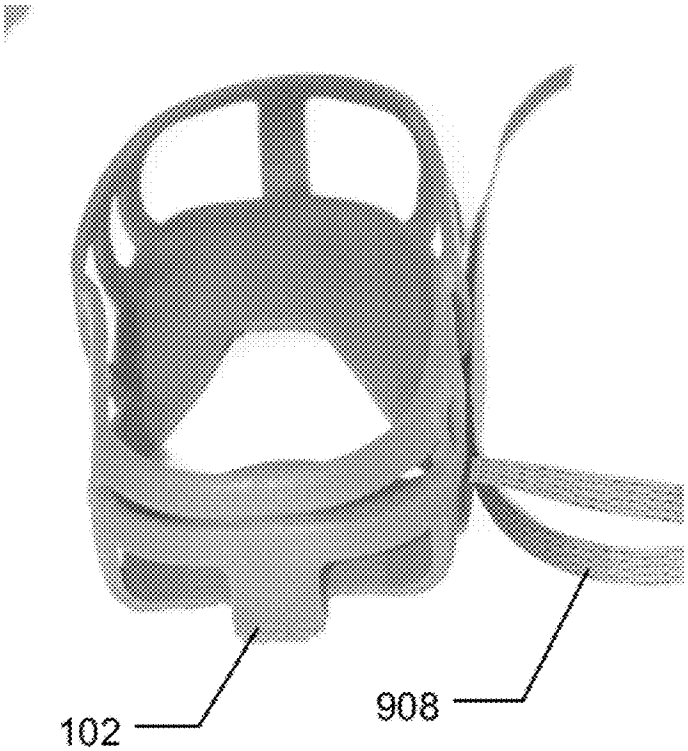
FIG. 16 depicts an oblique rear view of a three-dimensional representation of an embodiment of the overshoe.
Figure 17:
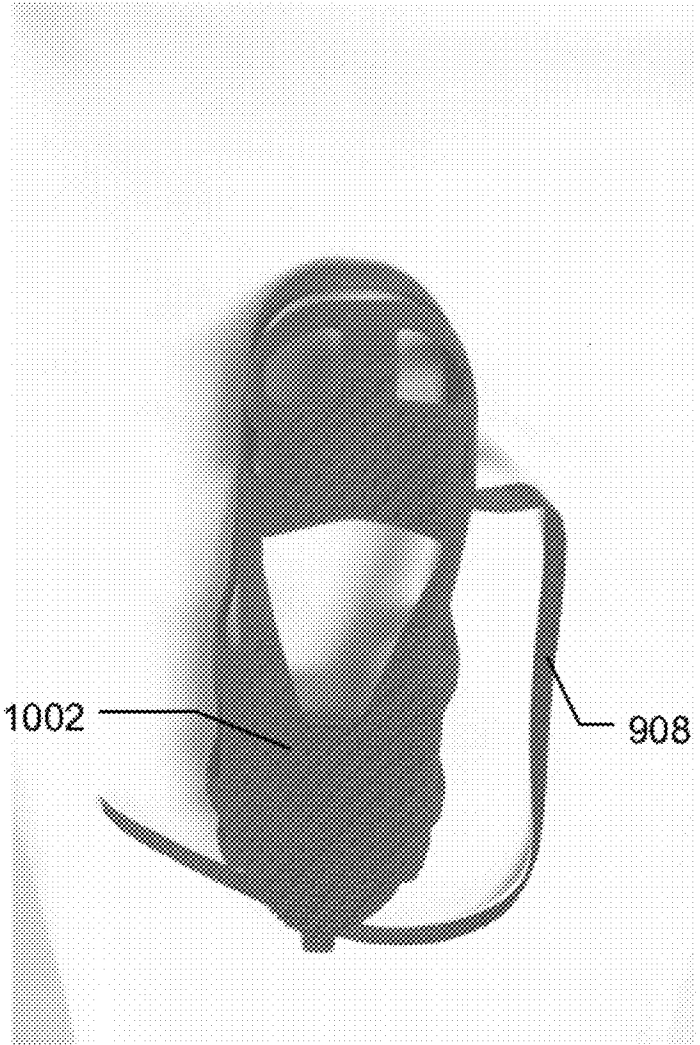
FIG. 17 depicts a bottom view of a three-dimensional representation of an embodiment of the overshoe.

FIG. 16 depicts an oblique rear view of a three-dimensional representation of an embodiment of the overshoe, including a conductive strap or ribbon 908 that is attached to the overshoe. As depicted in FIG. 16, the overshoe may include a heel band 102. FIG. 17 depicts a bottom view of a three-dimensional representation of an embodiment of the overshoe, including a conductive strap or ribbon 908 that is attached to the overshoe. FIG. 17 includes a general view of the tread pattern 1002.

Figure 18:
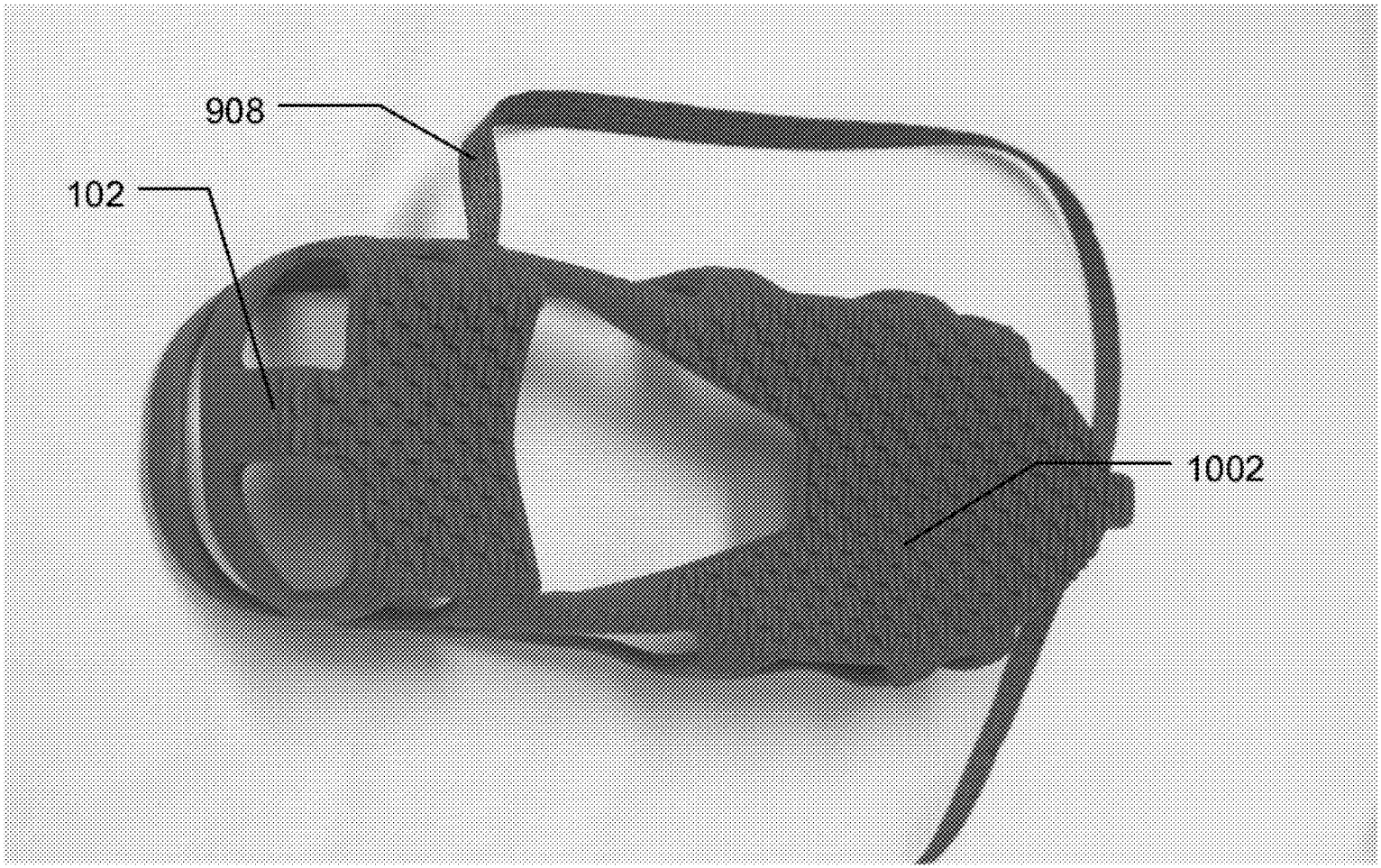
FIG. 18 depicts an oblique bottom view of a three-dimensional representation of an embodiment of the overshoe.
Figure 19:
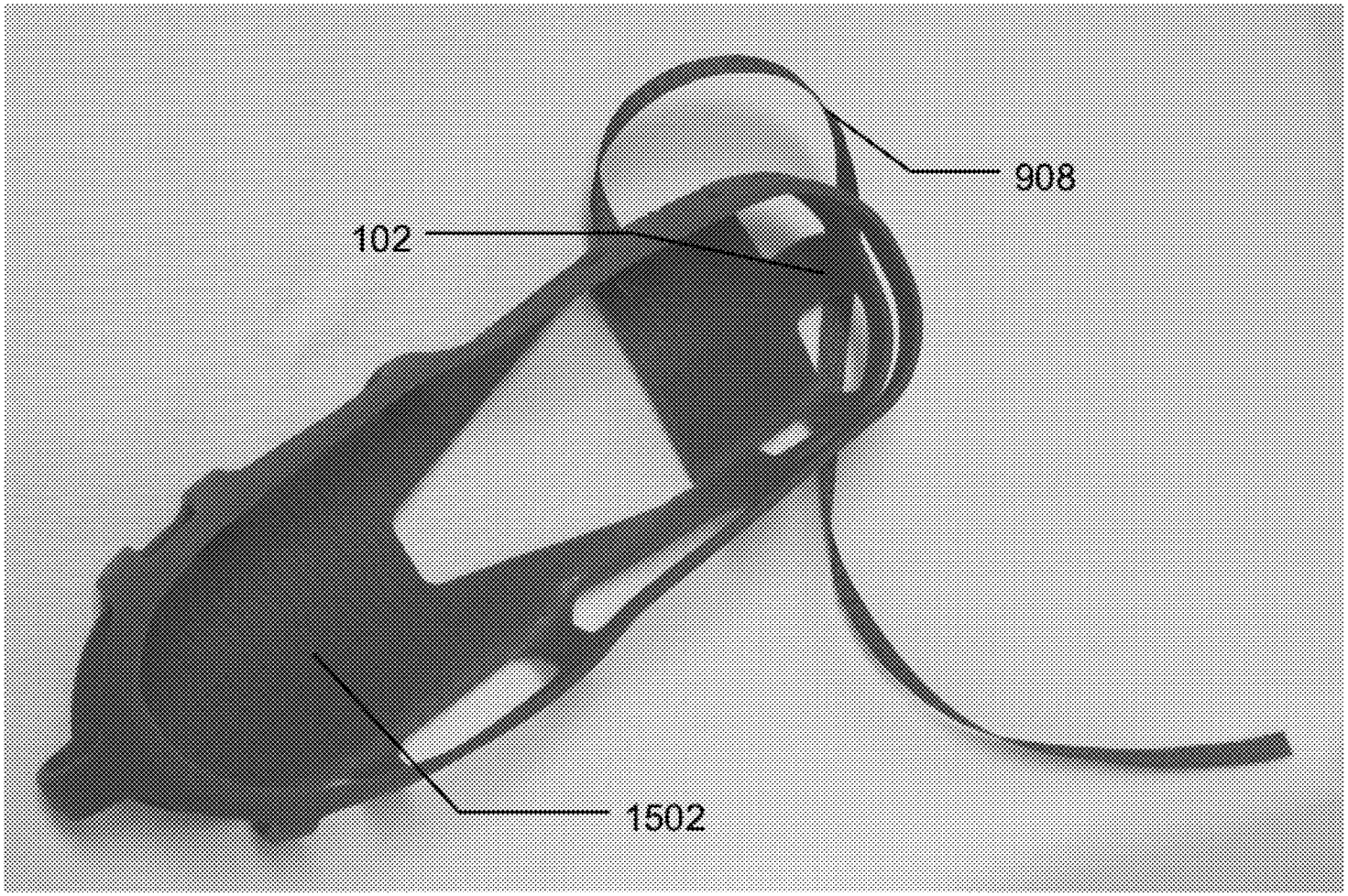
FIG. 19 depicts an oblique top view of a three-dimensional representation of an embodiment of the overshoe.

FIG. 18 depicts an oblique bottom view of a three-dimensional representation of an embodiment of the overshoe, including a conductive strap or ribbon 908 that is attached to the overshoe. As depicted in FIG. 18, the overshoe may include a heel band 102 and a tread pattern 1002. FIG. 19 depicts an oblique top view of a three-dimensional representation of an embodiment of the overshoe, including a conductive strap or ribbon 908 that is attached to the overshoe. As depicted in FIG. 19, the overshoe may include a heel band 102 and a tread pattern on the surface that comes into contact with the footwear of the wearer 1502.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended listing of inventive concepts. Although specific terms are employed herein, they are used in a generic and descriptive sense only and not for purposes of limitation.

What is claimed is:

1. An electrostatic discharging, detachable, overshoe, comprising:

an electrically conductive flexible skeleton overshoe for placing over footwear, wherein the skeleton overshoe is constructed of a molded dissipative material; and a conductive strap molded to the skeleton overshoe and positioned to be in contact with a body of a wearer of the footwear, wherein the skeleton overshoe dissipative material provides a conductive conduit to transmit an electric charge from the conductive strap to a grounded surface.

2. The overshoe of claim 1 wherein the dissipative material contains one of nitrile rubber or polyurethane.

3. The overshoe of claim 1 wherein the dissipative material consists of one of nitrile rubber or polyurethane.

4. The overshoe of claim 1 wherein the dissipative material includes at least one of carbon, silver, carbon black, conductive silicone, polyacetylene, nanopolyacetylene, dissipative vinyl, carbon nanotubes, thermoplastic elastomer and polyurethane.

5. The overshoe of claim 1 further comprising the conductive strap attached to the skeleton overshoe by an attachment means.

6. The overshoe of claim 1 wherein the overshoe is an open frame skeleton construction.

7. The overshoe of claim 1, wherein the overshoe is unchanged after processing in at least one of a washing machine or an autoclave.

8. The overshoe of claim 1, wherein the flexible skeleton overshoe is configured to stretch over the footwear to make a contact fit with the footwear.

9. An electrostatic discharging, detachable, overshoe, comprising:

an electrically conductive flexible skeleton overshoe for placing over footwear, wherein the skeleton overshoe is constructed of a molded dissipative material;

a conductive strap molded to the skeleton overshoe and positioned to be in contact with a body of a wearer of the footwear, wherein the skeleton overshoe dissipative material provides a conductive conduit to transmit an electric charge from the conductive strap to a grounded surface; and a resistor in series with the conductive strap and the skeleton overshoe.

10. The overshoe of claim 9 wherein the resistor has a resistance value of between 1 mega ohm and 10 mega ohms.

11. The overshoe of claim 9 wherein the resistor is a current limiting resistor.

12. The overshoe of claim 9 wherein the overshoe is an open frame skeleton construction.

13. The overshoe of claim 9, wherein the overshoe is unchanged after processing in at least one of a washing machine or an autoclave.

14. The overshoe of claim 9, wherein the flexible skeleton overshoe is configured to stretch over the footwear to make a contact fit with the footwear.

15. An electrostatic discharging, detachable, overshoe, comprising:

an electrically conductive flexible skeleton overshoe for placing over footwear, wherein the skeleton overshoe is constructed of a molded dissipative material;

a conductive strap molded to the skeleton overshoe and positioned to be in contact with a body of a wearer of the footwear, wherein the skeleton overshoe dissipative material provides a conductive conduit to transmit an electric charge from the conductive strap to a grounded surface; and wherein an interface between the skeleton overshoe and the grounded surface has a coefficient of friction of 0.5 or greater.

16. The overshoe of claim 15 wherein a lower surface of the overshoe includes a tread pattern.

17. The overshoe of claim 15 wherein a lower surface of the overshoe includes the dissipative material.

18. The overshoe of claim 15 wherein the dissipative material contains one of nitrile rubber or polyurethane.

19. The overshoe of claim 15 wherein the dissipative material consists of one of nitrile rubber or polyurethane.

20. The overshoe of claim 15 wherein the dissipative material includes at least one of carbon, silver, carbon black, conductive silicone, polyacetylene, nanopolyacetylene, dissipative vinyl, carbon nanotubes, thermoplastic elastomer and polyurethane.

21. The overshoe of claim 15 wherein the overshoe is an open frame skeleton construction.

22. The overshoe of claim 15, wherein the overshoe is unchanged after processing in at least one of a washing machine or an autoclave.

23. The overshoe of claim 15, wherein the flexible skeleton overshoe is configured to stretch over the footwear to make a contact fit with the footwear.

* * * * *